US010344719B1

(12) United States Patent
Wald et al.

(10) Patent No.: US 10,344,719 B1
(45) Date of Patent: Jul. 9, 2019

(54) INTAKE SYSTEMS FOR STERN DRIVES HAVING INTAKE SILENCERS

(71) Applicant: Brunswick Corporation, Lake Forest, IL (US)

(72) Inventors: Benjamin C. Wald, Perkins, OK (US); Matthew L. Mauk, Stillwater, OK (US); Michael J. Biel, Beaver Dam, WI (US)

(73) Assignee: Brunswick Corporation, Mettawa, IL (US)

( * ) Notice: Subject to any disclaimer, the term of this patent is extended or adjusted under 35 U.S.C. 154(b) by 323 days.

(21) Appl. No.: 15/174,201

(22) Filed: Jun. 6, 2016

(51) Int. Cl.
*F02M 35/10* (2006.01)
*F02M 35/12* (2006.01)

(52) U.S. Cl.
CPC ..... *F02M 35/10019* (2013.01); *F02M 35/10347* (2013.01); *F02M 35/1261* (2013.01); *F02M 35/1266* (2013.01)

(58) Field of Classification Search
CPC ..... F02B 61/045; F02M 35/167; F02M 35/1233; F02M 35/1216; F02M 35/12; F02M 35/10019; F02M 35/1266; F02M 35/10347; F02M 35/1261
See application file for complete search history.

(56) References Cited

U.S. PATENT DOCUMENTS

| | | | | |
|---|---|---|---|---|
| 5,900,595 | A * | 5/1999 | Akima | F02M 35/14 181/229 |
| 5,957,072 | A * | 9/1999 | Hattori | B63B 35/731 114/55.57 |
| 6,450,847 | B1 * | 9/2002 | Kashima | F01M 11/03 440/88 A |
| 9,643,702 | B2 * | 5/2017 | Shomura | B63H 20/001 |
| 2002/0117138 | A1 * | 8/2002 | Katayama | F02B 61/045 123/184.21 |
| 2006/0135008 | A1 * | 6/2006 | Ito | B63H 20/285 440/77 |
| 2010/0255737 | A1 * | 10/2010 | Inaba | F02M 35/167 440/88 A |
| 2015/0093948 | A1 * | 4/2015 | Kinpara | B63H 20/001 440/88 A |

* cited by examiner

*Primary Examiner* — Sizo B Vilakazi
(74) *Attorney, Agent, or Firm* — Andrus Intellectual Property Law, LLP

(57) ABSTRACT

An intake system is for a marine drive. The intake system comprises a throttle device that receives intake air for combustion; an intake conduit that conveys the intake air to the throttle device, wherein the intake conduit has an upstream inlet end, a downstream outlet end, and a radially outer surface that extends from the upstream inlet end to the downstream outlet end; and an intake silencer coupled to the radially outer surface and configured to attenuate sound emanating from the intake system.

7 Claims, 5 Drawing Sheets

INTAKE SYSTEMS FOR STERN DRIVES HAVING INTAKE SILENCERS

FIELD

The present disclosure relates to internal combustion engines for marine drives.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, an intake system is for a marine drive. The intake system comprises a throttle device; an intake conduit that conveys intake air to the throttle device, wherein the intake conduit has an upstream inlet end, a downstream outlet end, and a radially outer surface that extends from the upstream inlet end to the downstream outlet end; and an intake silencer coupled to the radially outer surface and configured to attenuate sound emanating from the intake system.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
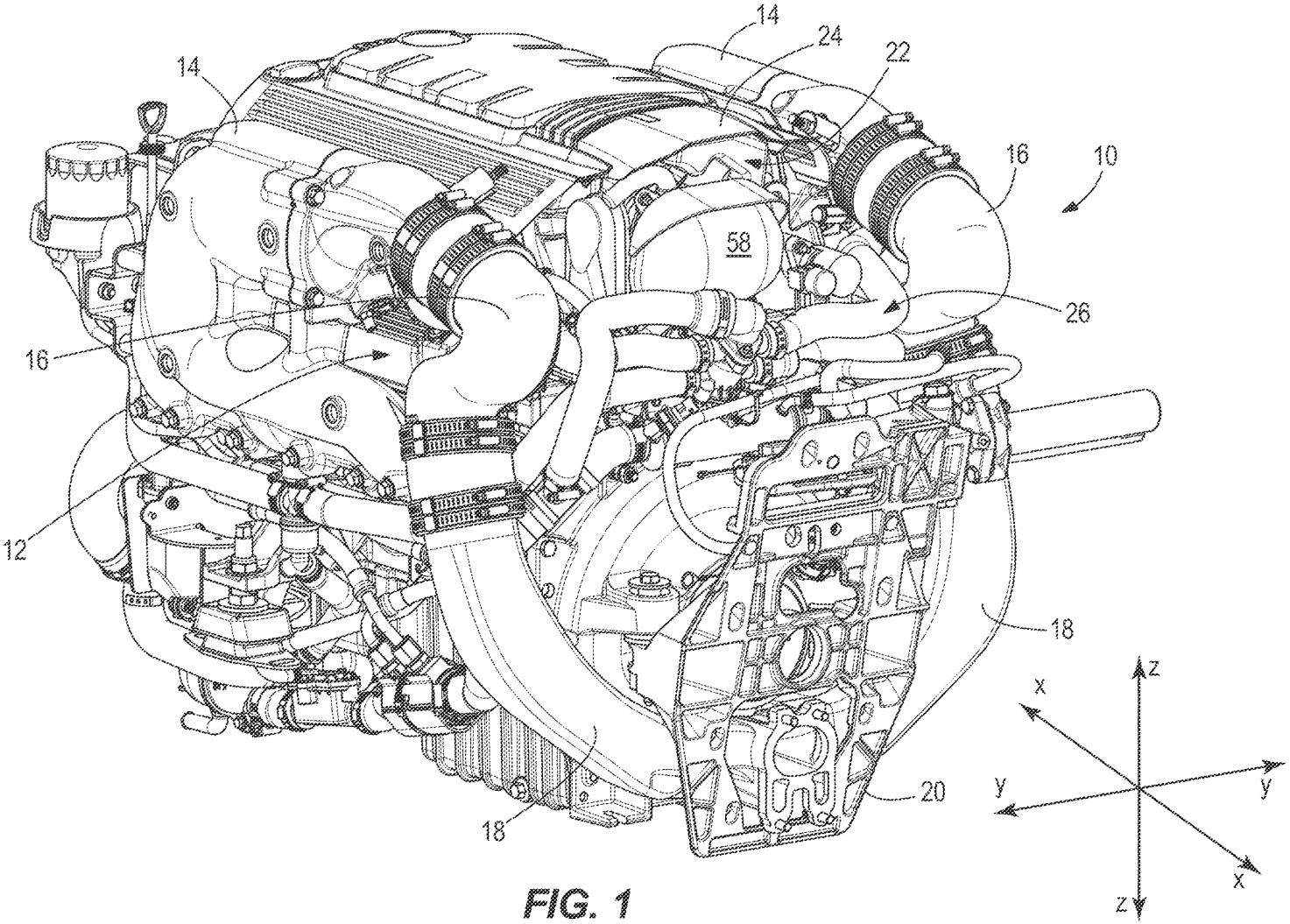
FIG. 1 is a perspective view of a marine drive having an internal combustion engine.
Figure 2:
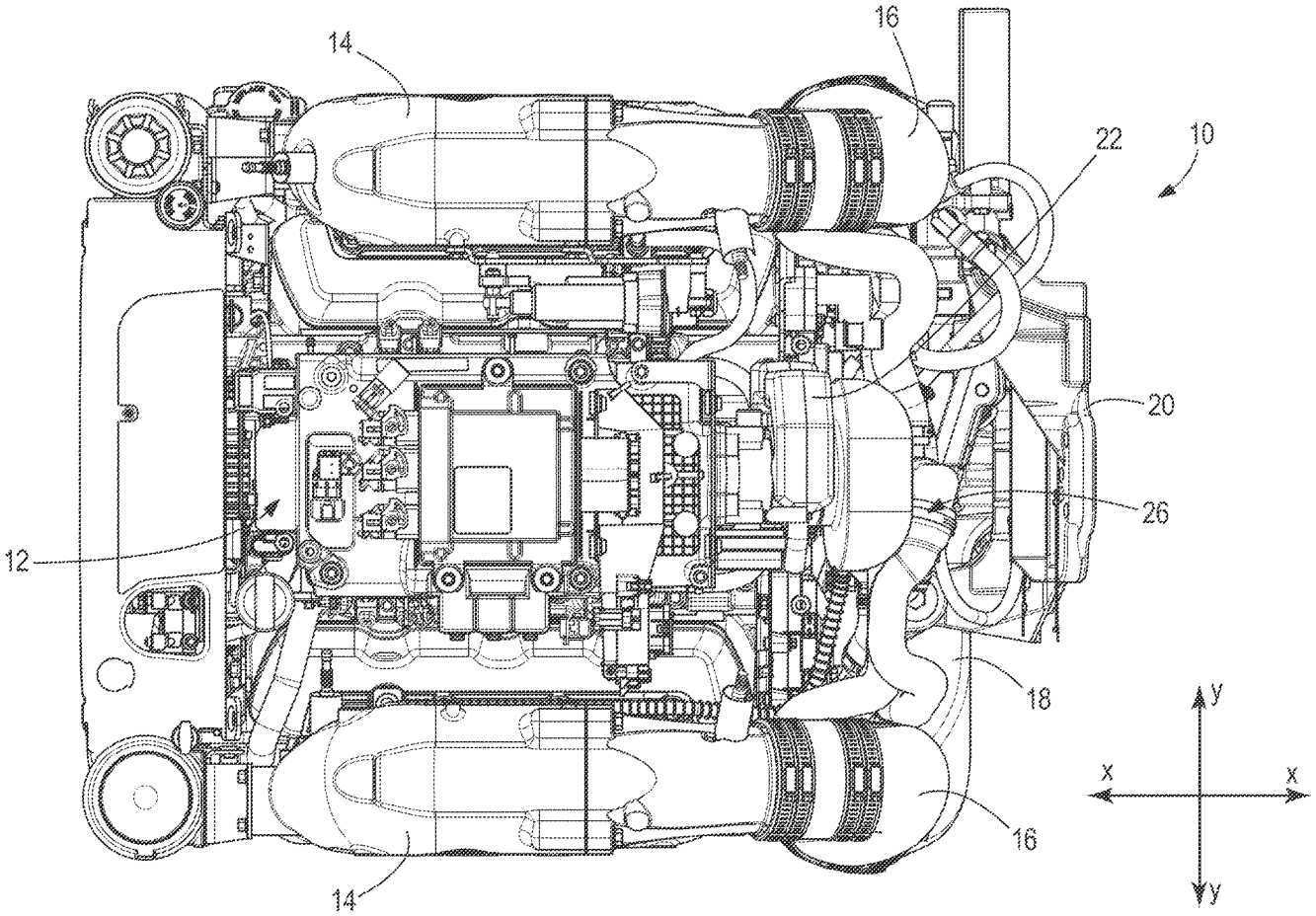
FIG. 2 is a top view of the marine drive shown in FIG. 1 with a cover removed to show portions of an exemplary intake system according to the present disclosure.
Figure 3:
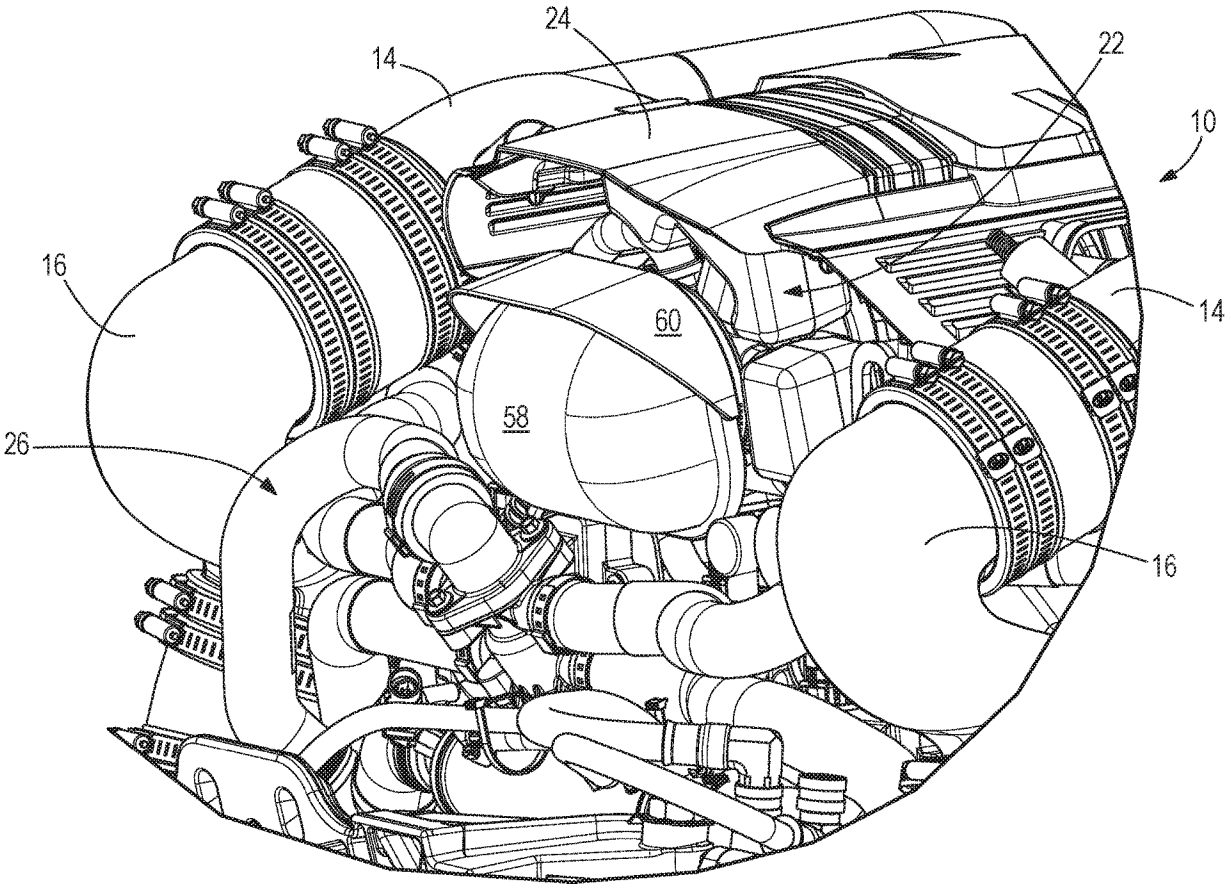
FIG. 3 is a perspective view of a portion of the marine drive where the intake system is located.

FIGS. 1-3 depict a marine drive 10 for powering a marine vessel (not shown) in water. As shown in the drawings, the marine drive 10 extends in three dimensions, from front to back in a longitudinal direction X, from side to side in a lateral direction Y that is perpendicular to the longitudinal direction X, and from top to bottom in a vertical direction Z that is perpendicular to the longitudinal direction X and perpendicular to the lateral direction Y. The illustrated example is a sterndrive, however the concepts provided in the present disclosure are not limited for use with sterndrives. The marine drive 10 includes an internal combustion engine 12 that emits exhaust gases from the combustion process via port and starboard exhaust manifolds 14. The exhaust manifolds 14 each convey the exhaust gases via respective exhaust elbows 16 to a Y-pipe 18 that combines the exhaust gases from the respective exhaust manifolds 14 for discharge through the transom of the marine vessel via a transom plate 20.

The marine drive 10 also includes an intake system 22, which is a subject of the present disclosure. The intake system 22 is disposed between the dual exhaust manifolds 14 and is configured to convey intake air for combustion in the internal combustion engine 12. The intake system 22 is uniquely configured to fit in a space defined between the dual exhaust manifolds 14, below a cover plate 24 extending between the dual exhaust manifolds 14, and in front of other engine components including a cooling circuit 26 for providing cooling fluid to the internal combustion engine 12. Thus, the intake system 22 is located below the cover plate 24, between the dual exhaust manifolds 14, forwardly of the cooling circuit 26, and on top of the internal combustion engine 12.

Figure 4:
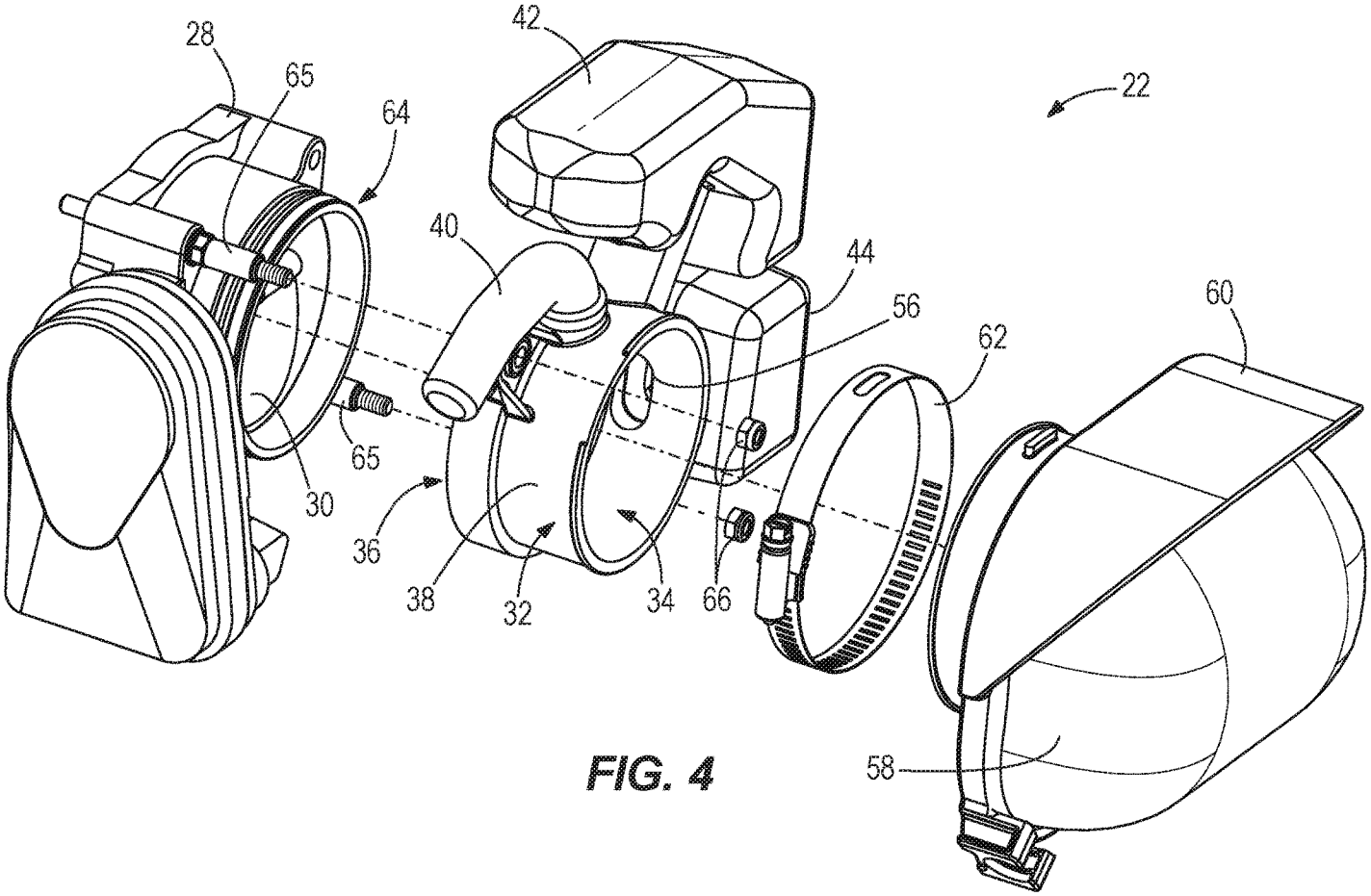
FIG. 4 is an exploded view of the intake system.

The exact configuration of the intake system 22 can vary from that which is shown. One example is depicted in FIGS. 4 and 5A-5C. Referring to FIG. 4, the intake system 22 includes a throttle device 28 that is coupled to the internal combustion engine 12 and configured to receive and control flow of intake air for combustion in the internal combustion engine 12. The throttle device 28 has a throttle plate 30 that is actuated in a conventional manner for increasing or decreasing the amount of air flow to the internal combustion engine 12. The intake system 22 further includes an intake conduit 32 that is coupled to and conveys the intake air to the throttle device 28. The intake conduit 32 has an upstream inlet end 34, a downstream outlet end 36 coupled to the throttle device 28, and a radially outer surface 38 that extends from the upstream inlet end 34 to the downstream outlet end 36.

Figure 5A:
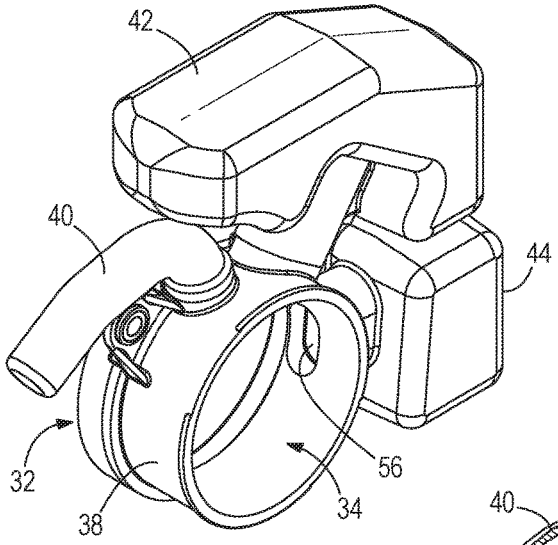
FIGS. 5A-5C are views of an intake conduit and intake silencers of the intake system.
Figure 5B:
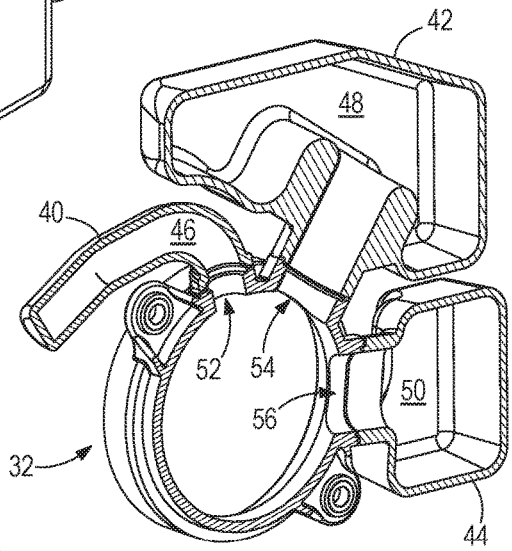
Figure 5C:
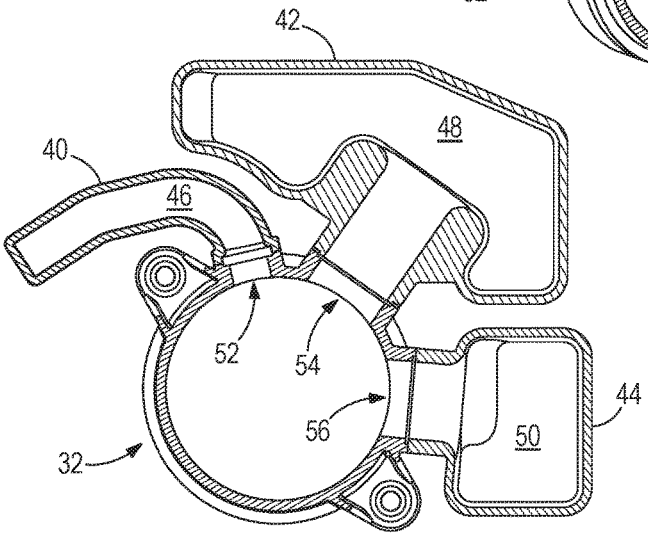

Referring to FIGS. 5A-5C, a plurality of intake silencers 40, 42, 44 are coupled to the radially outer surface 38 and are configured to attenuate sound emitting from the intake system 22. The type and configuration of intake silencer can vary from that which is shown. In the illustrated example, each intake silencer 40, 42, and 44 is specially configured to attenuate a certain frequency of sound emanating from the intake system 22 of the particular internal combustion engine 12 to which the intake system 22 is attached. Each intake silencer 40, 42, 44 forms a closed volume 46, 48, 50 that is connected to a respective radial aperture 52, 54, 56 radially formed through the intake conduit 32. In some examples, the intake conduit 32 is formed by injection molding and the intake silencers 40, 42, 44 are welded to the radially outer surface 38 of the intake conduit 32. In the depicted example, intake silencer 40 is a quarter wave resonator and intake silencers 42, 44 are Helmholtz resonators. Again however, the type and configuration of intake silencer can vary from that which is shown and can be specially tuned for optimal functionality.

Advantageously, the intake silencers 40, 42, 44 are specially configured to attenuate sound emanating from the intake system while not impeding airflow along the intake conduit 32 from the upstream inlet end 34 to the downstream outlet end 36 and attached throttle device 28. That is, each intake silencer 40, 42, 44 thus does not negatively affect airflow efficiency through the intake conduit 32 because each intake silencer 40, 42, 44 is disposed radially outside the axial path of air flow through the intake conduit 32.

In the example shown in FIGS. 1-4, the intake system 22 further includes an optional flame arrester 58 that is coupled to the upstream inlet end 34 of the intake conduit 32. In this example, the intake air flows from the flame arrester 58 through the intake conduit 32 and to the throttle device 28 for combustion in the internal combustion engine 12. A splashguard 60 is disposed on top of the flame arrester 58 and is specially configured to prevent ingress of water to the intake system 22, via for example water that splashes into the noted marine vessel.

The throttle device 28, intake conduit 32 and flame arrestor 58 can be connected together by any one of a variety of connection devices. In the illustrated example, a clamp 62 is provided for connecting the flame arrestor 58 to the inlet end 34 of the intake conduit 32. The outlet end 36 of the intake conduit 32 is connected to the throttle device 28 by fasteners and nuts 65, 66. A seal 64 provides an airtight seal between the intake conduit 32 and throttle device 28.

The present disclosure thus provides intake systems and marine drives for marine vessels wherein the intake system is sufficiently packaged with respect to the marine drive 10 between dual exhaust manifolds 14, below cover plate 24, forwardly of cooling circuit 26 and on top of internal combustion engine 12. The intake system 22 can include a plurality of intake silencers 40, 42, 44 that are coupled to the radially outer surface 38 of the intake conduit 32 and are uniquely configured to attenuate sound emanating from the intake system while not negatively affecting airflow efficiency through the intake system.

What is claimed is:

1. A marine drive that extends from front to back in a longitudinal direction, from side to side in a lateral direction that is perpendicular to the longitudinal direction, and from top to bottom in a vertical direction that is perpendicular to the longitudinal direction and perpendicular to the lateral direction, the marine drive comprising:

an internal combustion engine;

dual exhaust manifolds located on laterally opposite sides of the internal combustion engine;

a cooling circuit that provides cooling fluid to the internal combustion; and an intake system located vertically above the internal combustion engine, laterally between the dual exhaust manifolds, and longitudinally forwardly of the cooling circuit, wherein the intake system is configured to convey intake air for combustion in the internal combustion engine, wherein the intake system comprises a throttle device that receives and controls flow of air for combustion in the internal combustion engine;

an intake conduit that conveys intake air to the throttle device, wherein the intake conduit has an upstream inlet end, a downstream outlet end, and a radially outer surface that longitudinally extends between the upstream inlet end and the downstream outlet end;

an intake silencer coupled to the radially outer surface and configured to attenuate sound emanating from the intake system; and a radial aperture in the radially outer surface;

wherein the intake silencer comprises a closed volume that is coupled to the radial aperture and located outside of the intake conduit so that the intake silencer does not negatively affect airflow efficiency through the intake conduit.

2. The marine drive according to claim 1, further comprising a cover plate extending between the dual exhaust manifolds, wherein the intake system is disposed in a space below the cover plate.

3. The marine drive according to claim 1, wherein the intake silencer comprises one of a plurality of intake silencers, each intake silencer in the plurality of intake silencers being coupled to the radially outer surface and configured to attenuate sound emanating from the intake system, wherein the radial aperture is one of a plurality of radial apertures in the radially outer surface and wherein each intake silencer in the plurality of intake silencers is coupled to a respective one of the plurality of radial apertures.

4. The marine drive according to claim 3, wherein each of the intake silencers is configured to attenuate a different respective frequency of sound emanating from the intake system.

5. The marine drive according to claim 1, wherein the intake conduit defines an axial path of air flow and wherein the intake silencer is disposed radially outside of the axial path of air flow.

6. The marine drive according to claim 1, further comprising a flame arrestor coupled to the upstream inlet end of the intake conduit, wherein the intake system is located longitudinally forwardly of the flame arrestor.

7. The marine drive according to claim 1, further comprising a cover plate extending between the dual exhaust manifolds, wherein the intake system is disposed in a space below the cover plate; and a flame arrestor coupled to the upstream inlet end of the intake conduit, wherein the intake system is located longitudinally forwardly of the flame arrestor, wherein the intake conduit defines an axial path of air flow and wherein the intake silencer is disposed radially outside of the axial path of air flow.

* * * * *